US007934497B1

(12) United States Patent
Grove et al.

(10) Patent No.: US 7,934,497 B1
(45) Date of Patent: May 3, 2011

(54) MODULAR HELMET-MASK ASSEMBLY

(75) Inventors: Corey M. Grove, Red Lion, PA (US); Stephen E. Chase, Jarrettsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 2409 days.

(21) Appl. No.: 09/992,684

(22) Filed: Nov. 19, 2001

(51) Int. Cl.
*A62B 7/10* (2006.01)

(52) U.S. Cl. ..... 128/201.25; 128/201.19; 128/201.22; 128/201.23; 128/201.24; 2/5; 2/6.3; 2/6.5; 2/6.6; 2/6.7

(58) Field of Classification Search ..... 128/201.19, 128/201.22, 201.23, 201.24, 201.25; 2/5, 2/6.1–6.7, 8.2–8.8, 417, 421, 422, 10, 426–435, 2/441, 9
See application file for complete search history.

(56) References Cited

U.S. PATENT DOCUMENTS 3,433,222 A * 3/1969 Pinto ..... 128/201.24
3,910,269 A * 10/1975 Ansite et al. ..... 128/201.24
3,943,572 A * 3/1976 Aileo ..... 2/209
4,288,268 A * 9/1981 Hartung ..... 156/245
4,549,541 A * 10/1985 Sundahl ..... 128/201.19
4,667,348 A * 5/1987 Sundahl ..... 2/410
4,676,236 A * 6/1987 Piorkowski et al. ..... 128/201.23
4,886,056 A * 12/1989 Simpson ..... 128/201.25
4,986,282 A * 1/1991 Stackhouse et al. ..... 128/857
5,038,776 A * 8/1991 Harrison et al. ..... 128/207.11
5,078,130 A * 1/1992 Van Oosten et al. ..... 128/201.24
5,191,882 A * 3/1993 Vogliano ..... 128/207.11
5,291,880 A * 3/1994 Almovist et al. ..... 128/201.22
5,349,949 A * 9/1994 Schegerin ..... 128/201.24
5,509,436 A * 4/1996 Japuntich et al. ..... 137/15.18
5,555,569 A * 9/1996 Lane ..... 2/424
5,572,990 A * 11/1996 Berlin ..... 128/201.19
5,649,532 A * 7/1997 Griffiths ..... 128/206.24
5,758,639 A * 6/1998 Ikonen ..... 128/201.14
5,924,420 A * 7/1999 Reischel et al. ..... 128/206.21
6,006,366 A * 12/1999 Vondrak ..... 2/10
6,121,881 A * 9/2000 Bieback et al. ..... 128/201.19
6,279,172 B1 * 8/2001 Epperson et al. ..... 2/410
6,481,019 B2 * 11/2002 Diaz et al. ..... 2/171.3
6,513,168 B2 * 2/2003 Paris et al. ..... 2/171.3

* cited by examiner

*Primary Examiner* — Gary Jackson
*Assistant Examiner* — Michael G Mendoza
(74) *Attorney, Agent, or Firm* — Ulysses John Biffoni

(57) ABSTRACT

A modular helmet-mask assembly for protecting a user's head and face from hazards such as from chemical and biological warfare agents. The invention includes an impact resistant helmet; a face protection assembly, which can be attached and detached from the helmet; and a transparent, impact resistant lens. The face protection assembly includes an impact resistant face protection shell with a vision port, through which the transparent lens can be positioned; a flexible nosecup assembly positioned to engage the mouth and nose of the user, which also includes a breathe-through airflow assembly and filter unit; and a flexible face seal which surrounds the nosecup assembly and lens and engages the face of the user. An adjustable head harness is attached to the shell or face seal, for adjustably securing the face seal and nosecup to the user's face to maximize comfort and protection while preventing fogging of the lens.

14 Claims, 4 Drawing Sheets

MODULAR HELMET-MASK ASSEMBLY

GOVERNMENT INTEREST

The invention described herein may be manufactured, licensed, and used by or for the U.S. Government.

BACKGROUND OF THE INVENTION

1. Field of the Invention

The present invention relates to respiratory masks, or more particularly to modular respiratory masks that offer protection from hazardous chemical and/or biological warfare agents and the like.

2. Description of the Related Art

Protective masks are currently used by the military for protection against chemical and biological contaminants. However, such masks often impose a substantial physiological burden on the wearer. These masks are typically difficult to wear for prolonged periods because they are relatively bulky and heavy, have high breathing resistance, impair vision and communications, cause thermal stress, physical discomfort, and degrade job performance. Furthermore, the demands placed on such protective masks for use by the crews of military vehicles, such as land and sea vehicles and aircraft, are even greater due to the limitations on the size or bulk of such masks in crowded crew cabins, the need to avoid fogging of the lenses, and crew person exhaustion from heat buildup, physical discomfort, and respiratory effort.

Thus, mask systems used by military crews, and particularly vehicle crews, must be optimized for minimal bulk and weight, in order to readily fit within the limited crew space provided. In addition, such masks must be optimized to provide a sufficient flow of purified air for enhancing respiration and comfort, while minimizing lens fogging, heat stress, respiratory effort, and excessive pressure caused by the mask seals on contacted parts of the user's face and head.

Previous efforts to provide crew masks include the U.S. Army M45 (Aircrew) and M42 (Combat Vehicle) masks. These masks use a standard six-point suspension system and an intern periphery design, where the contact point/seal between the mask and the skin of the user is provided by an inwardly turned mask edge. However, the M45 has no powered blower system due to weight and logistic concerns. While the M45 provides adequate unblown protection and defogging properties, this crew mask is known to be somewhat uncomfortable when used in combination with helmet systems, such as aircrew helmets, due to the harness buckles and the presence of the intern seal in the forehead area, where a crew helmet can press the seal into the forehead. In addition, the lack of a powered blower system results in high breathing resistance, adding to crew fatigue.

In an alternative approach, the U.S. Air Force AERP mask system eliminates the face seal, in favor of a neck seal design. In addition, both the U.S. Army M48/M49 and the U.S. Air Force AERP use a dual canister blower system for providing the overpressure needed for protection against inward diffusion of toxic agents, and to provide additional airflow for keeping the lenses free of moisture or fog. Existing blowers are built to provide for air flow rates of approximately 4 cubic feet per minute (CFM) and attendant overpressure. Given the need for an air flow of approximately 4 CFM, the presently employed blowers for all current crew mask systems are sub-optimal in size and bulk.

Thus, there remains a need in the art for a crew mask for protection against chemical or biological toxic agents that provides a comfortable face seal and helmet interface and an optimized size and bulk of the equipment, while still providing adequate protection and defogging.

The present invention provides a solution to this problem. The invention includes a modular helmet-mask assembly which includes a helmet, a face protection assembly, and a transparent, impact resistant lens. The helmet is made of an impact resistant material for protecting the user's head. The face protection assembly, which can be attached and detached from the helmet, includes a face protection shell which is also made of an impact resistant material, for protecting the head and face of the user. The shell includes a vision port through the shell at the level of the eyes of a user, through which a transparent lens can be positioned for protection of the user's eyes. The face protection assembly includes a flexible nosecup assembly within the shell and flexible face seal on an inner surface of the shell. The flexible nosecup assembly is positioned to engage the mouth and nose of the user, and it includes a breathe-through airflow assembly and filter unit. The flexible face seal is disposed on an inner surface of the shell around the nosecup assembly and the lens, such that the face seal engages the face of the user. A strap or harness is attached to the shell or face seal, for adjustably securing the face seal and nosecup to the user's face to maximize comfort and protection while preventing fogging of the lens.

SUMMARY OF THE INVENTION

The invention provides a modular helmet-mask assembly which comprises:

(a) a helmet capable of enclosing the head of a user, said helmet comprising an impact resistant material; and (b) a face protection assembly, alternately attachable to and detachable from a front part of said helmet, which face protection assembly comprises

- (i) a face protection shell comprising an impact resistant material;
- (ii) a vision port through the shell at the level of the eyes of a user;
- (iii) a flexible nosecup assembly within the shell, which nosecup assembly is positioned to engage the mouth and nose of a user, said nosecup comprising a breathe-through airflow assembly and a filter unit;
- (iv) a flexible face seal, disposed on an inner surface of the shell around the nosecup assembly and the vision port, which face seal is capable of engaging the face of a user; and
- (v) an adjustable head harness attached at an surface of the shell or the face seal which is capable of engaging the back of a user's head to thereby adjustably secure the face seal and nosecup assembly to a user's face, and (c) either (i) or (ii):

- (i) a transparent, impact resistant lens fixed to the vision port at the level of the eyes of a user;
- (ii) a transparent, impact resistant lens rotatably attached at the front part of the helmet and positioned to alternately engage and disengage with the vision port of the shell at the level of the eyes of a user.

The invention also provides a method for protecting a user's face from chemicals which comprises:

(I) providing a modular helmet-mask assembly which comprises

- (a) a helmet capable of enclosing the head of a user, said helmet comprising an impact resistant material; and
- (b) a face protection assembly, alternately attachable to and detachable from a front part of said helmet, which face protection assembly comprises (i) a face protection shell comprising an impact resistant material;

(ii) a vision port through the shell at the level of the eyes of a user;

(iii) a flexible nosecup assembly within the shell, which nosecup assembly is positioned to engage the mouth and nose of a user, said nosecup comprising a breathe-through airflow assembly and a filter unit;

(iv) a flexible face seal, disposed on an inner surface of the shell around the nosecup assembly and the vision port, which face seal is capable of engaging the face of a user; and (v) an adjustable head harness attached at an surface of the shell or the face seal which is capable of engaging the back of a user's head to thereby adjustably secure the face seal and nosecup assembly to a user's face, and (c) either (i) or (ii):

(i) a transparent, impact resistant lens fixed to the vision port at the level of the eyes of a user;

(ii) a transparent, impact resistant lens rotatably attached at the front part of the helmet and positioned to alternately engage and disengage with the vision port of the shell at the level of the eyes of a user;

(II) placing the face protection assembly onto a user's head such that the flexible face seal engages the user's face, and such that the nosecup assembly engages the user's mouth and nose;

(III) adjusting the an adjustable head harness such that the face seal and nosecup are secured to the user's face;

(IV) placing the helmet onto the user's head such that the helmet encloses the user's head and attaching the helmet to the face protection assembly; and (V) adjusting the helmet to secure the helmet, face seal, and nosecup assembly to the user's head.

DETAILED DESCRIPTION OF THE PREFERRED EMBODIMENT

Figure 1:
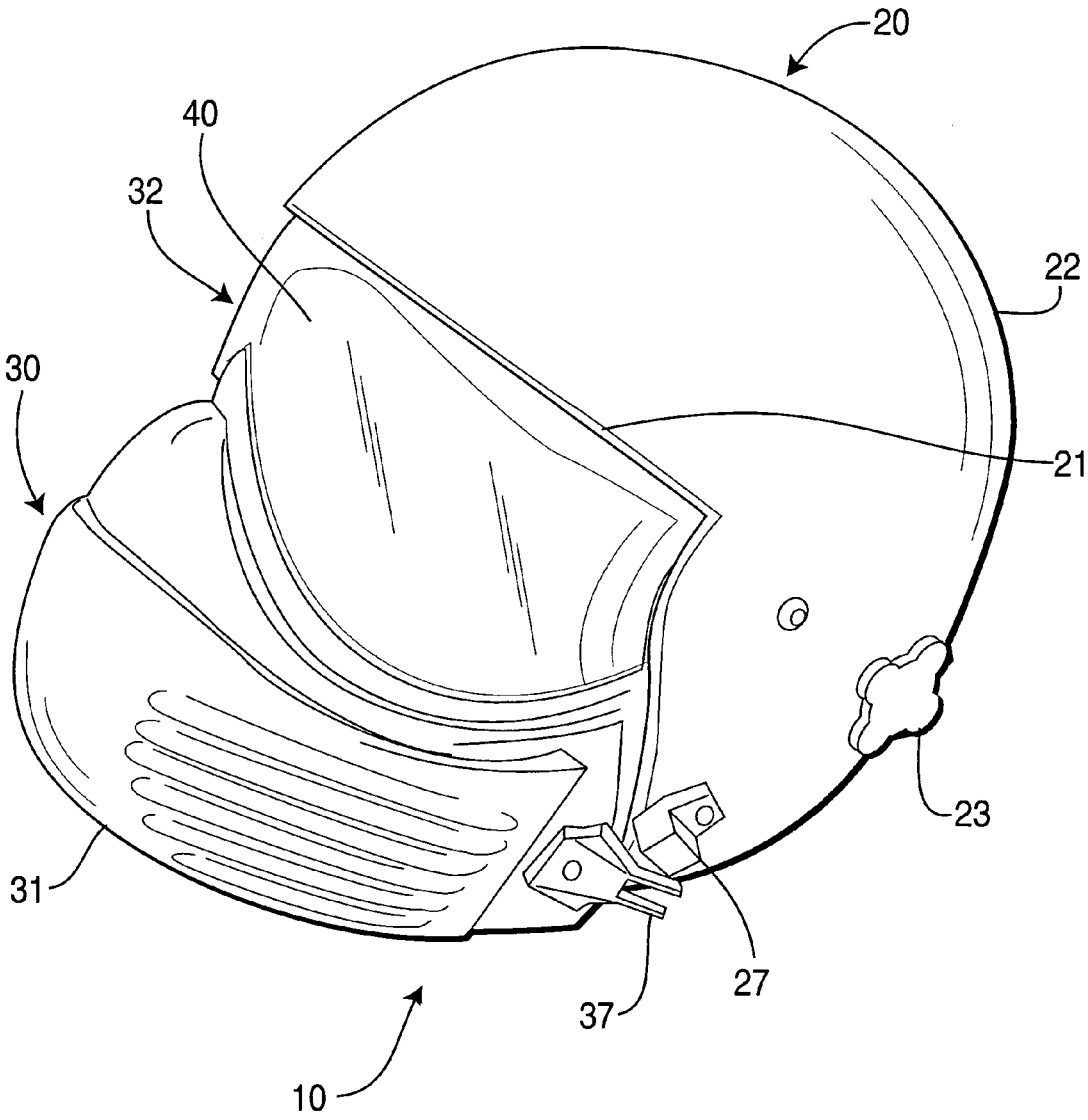
FIG. 1 shows a perspective view of a helmet-mask assembly of the invention showing the helmet portion attached to the face protection assembly portion.
Figure 2:
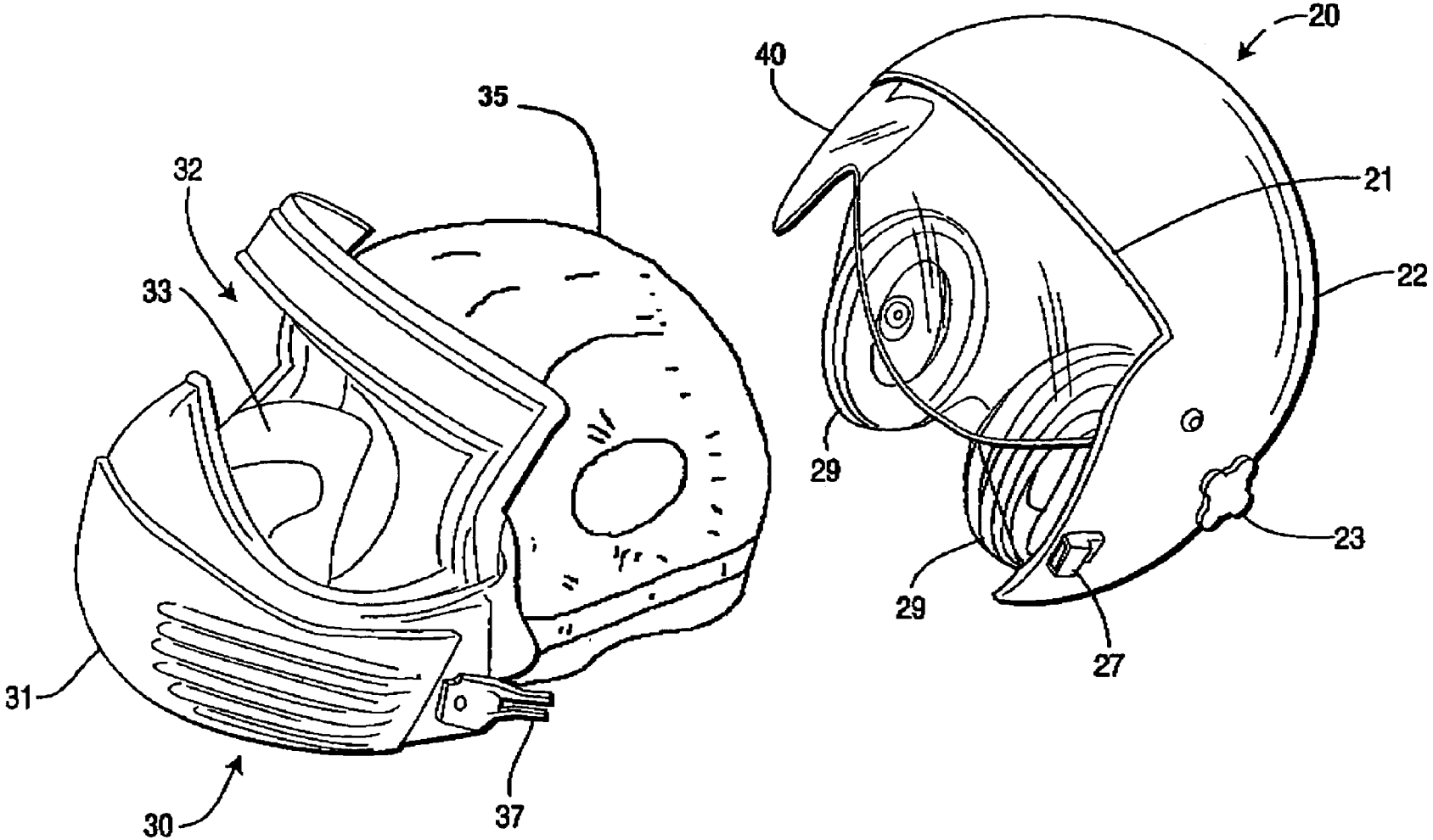
FIG. 2 shows a view of a helmet and mask of the helmet-mask assembly showing the helmet portion separated from the face protection assembly portion.

The invention provides a helmet-mask assembly for protecting the face and head of a user. FIGS. 1 and 2 respectively show a helmet-mask assembly 10 according to the invention in assembled and disassembled condition. As shown in FIG. 1, the helmet-mask assembly 10 comprises a helmet portion 20 and a mask portion, or face protection assembly, 30.

The helmet portion 20 is capable of enclosing the head of a user, and comprises an outer protective surface comprising an impact resistant material suitable for protecting the user's head. Suitable materials for the outer protective surface nonexclusively include graphite, fiberglass, Kevlar® (available commercially from E. I. du Pont de Nemours and Company, Wilmington, Del., USA), Spectra® (available commercially from Honeywell International Inc. of Morristown, N.J., USA), and the like, and combinations thereof.

The helmet has a front part 21 and a rear part 22. As shown in FIGS. 1 and 2, the front part 21 is attachable to and detachable from the face protection assembly 30. The helmet 10 preferably comprises attachment fasteners 27 for attaching and detaching the front part 21 of the helmet to the face protection assembly 30 as shown in FIG. 1. Suitable attachment fasteners nonexclusively include clips, snaps, straps, hooks, and the like.

Figure 3:
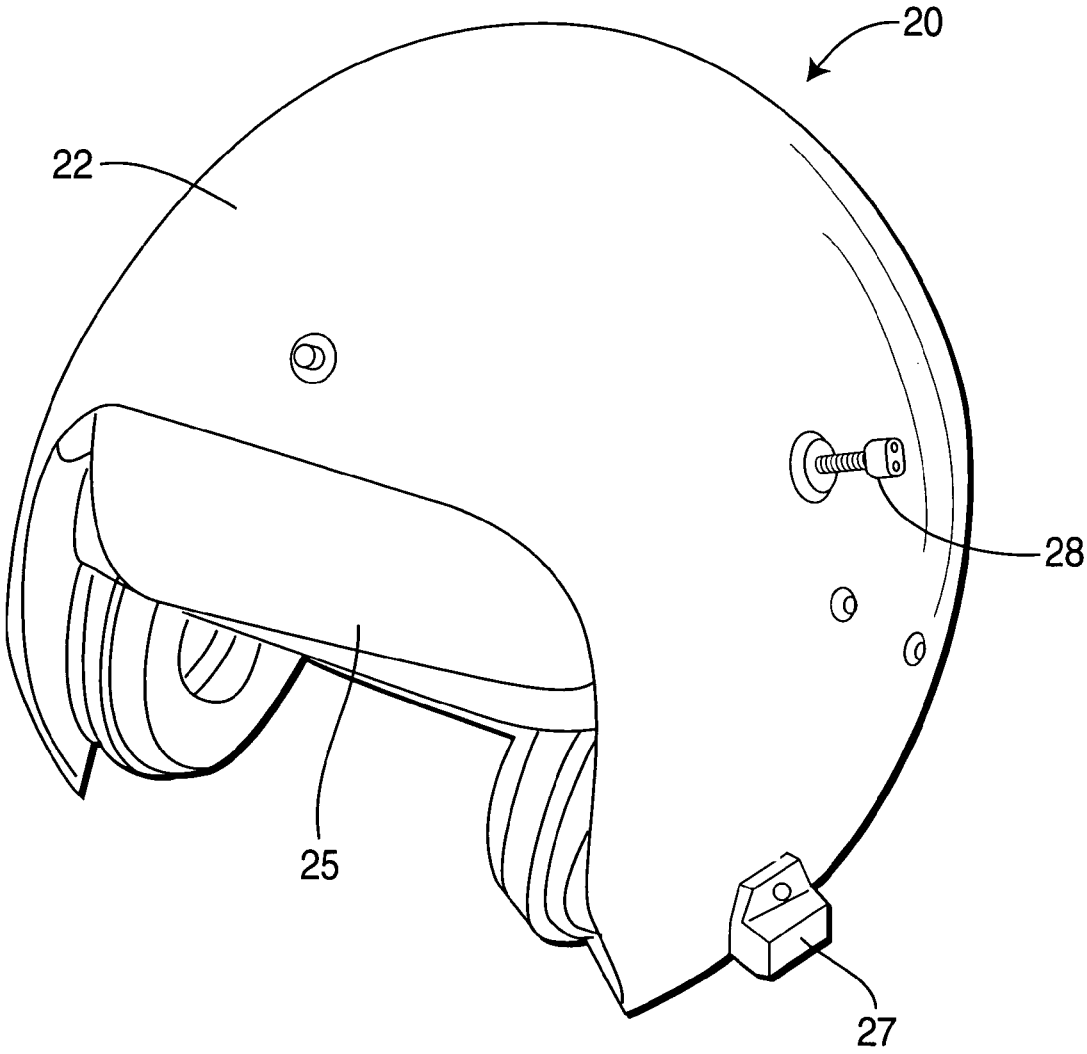
FIG. 3 shows a rear side perspective view of a helmet of the invention.

As shown in FIG. 2, the helmet 20 may comprise ear cups 29 for protection of the user's ears, or for radio communications purposes. The helmet may also contain an optional communications assembly comprising a microphone, a speaker, a transmitter and a receiver integrated with said helmet. FIG. 3 shows a communications port 28 which may be used to access such a communications assembly, if present.

FIG. 3 also shows a rear view of the helmet portion which has a position adjustable adjustment pad 25 which is preferably attached to a rear part 22 of the helmet 20. The adjustment pad 25 is capable of engaging the back of the user's head. The adjustment pad 25 comprises an impact resistant material, which is preferably the same material as the helmet portion and is capable of being adjusted to push the user's head forward towards a front part 21 of the helmet 20, and adjustably securing the face protection assembly to a user's face, as described below. The adjustment pad 25 may be adjusted using a tightening adjustment knob 23 or a tightening adjustment lever, or the like. FIGS. 1 and 2 show such a tightening adjustment knob 23 on the helmet 20. A suitable narrow band may be attached at one end to an inside of the helmet wall as well as to the adjustment pad 25 and then the tightening adjustment knob 23. The tightening adjustment knob 23 can the be turned, causing the adjustment pad 25 to move forward from the rear part 22 of the helmet towards the front part 21 of the helmet. Such action may be taken to move a user's head forward in the helmet, towards the mask portion of the helmet-mask assembly 10. The helmet may further comprise other additional features such as interior padding and the like.

The mask portion, or face protection assembly, 30, comprises a face protection shell 31, a vision port 32, a flexible nosecup assembly 33, a flexible face seal 34, and an adjustable head harness 35 attached to harness clips 36. The face protection shell 31 comprises an impact resistant material suitable for protecting a user's face. Suitable materials for the face protection shell nonexclusively include those listed above for the outer helmet surface including graphite, fiberglass, Kevlar® (available commercially from E. I. du Pont de Nemours and Company, Wilmington, Del., USA), Spectra® (available commercially from Honeywell International Inc. of Morristown, N.J., USA), and the like, and combinations thereof.

The vision port 32 comprises an opening extending through the face protection shell 31 at the level of the eyes of a user. The vision port 32 is sufficiently sized to allow the user to see through the shell 31 when it engages the user's head. The vision port 32 may optionally be fitted with a transparent, impact resistant lens, as described below.

The flexible nosecup assembly 33 is positioned on an inside surface of the face protection shell 31 such that the nosecup assembly 33 is capable of engaging the mouth and nose of the user. The nosecup assembly 33 comprises a flexible material, preferably an elastic material such as silicone rubber, and the like, and combinations thereof. The nosecup assembly 33 also comprises a breathe-through airflow assembly 38 and a filter unit 39 which may either be fitted inside of the nosecup assembly 33, or may be externally attached to it. Such breathe-through airflow assemblies may be a simple filter arrangement or may be attached to an oxygen supply as are well known in the art. The nosecup assembly 33 may optionally further comprise a port for connecting a source of breathing oxygen to the nosecup. The filter unit preferably comprises a filter element comprising a material capable of filtering chemical vapors and biological aerosols. Suitable filter materials nonexclusively include carbon filters such as bonded or packed-bed carbon filters. The nosecup assembly may also further comprise a negative pressure filter assembly, a positive pressure filter blower device, or a circulating filter blower device as are well known in the art.

The flexible face seal 34 is disposed on an inner surface and edge of the face protection shell 31, around the nosecup assembly 33 and the vision port 32. The face seal 34 is capable of engaging with the face of a user. This serves to protect the user's face from the entry of harmful chemical and biological hazards and the like. Suitable materials for the flexible face seal nonexclusively include an elastic material such as silicone rubber, and the like. The flexible face seal may comprise a material which is the same or different from the material of the flexible nosecup.

Figure 4:
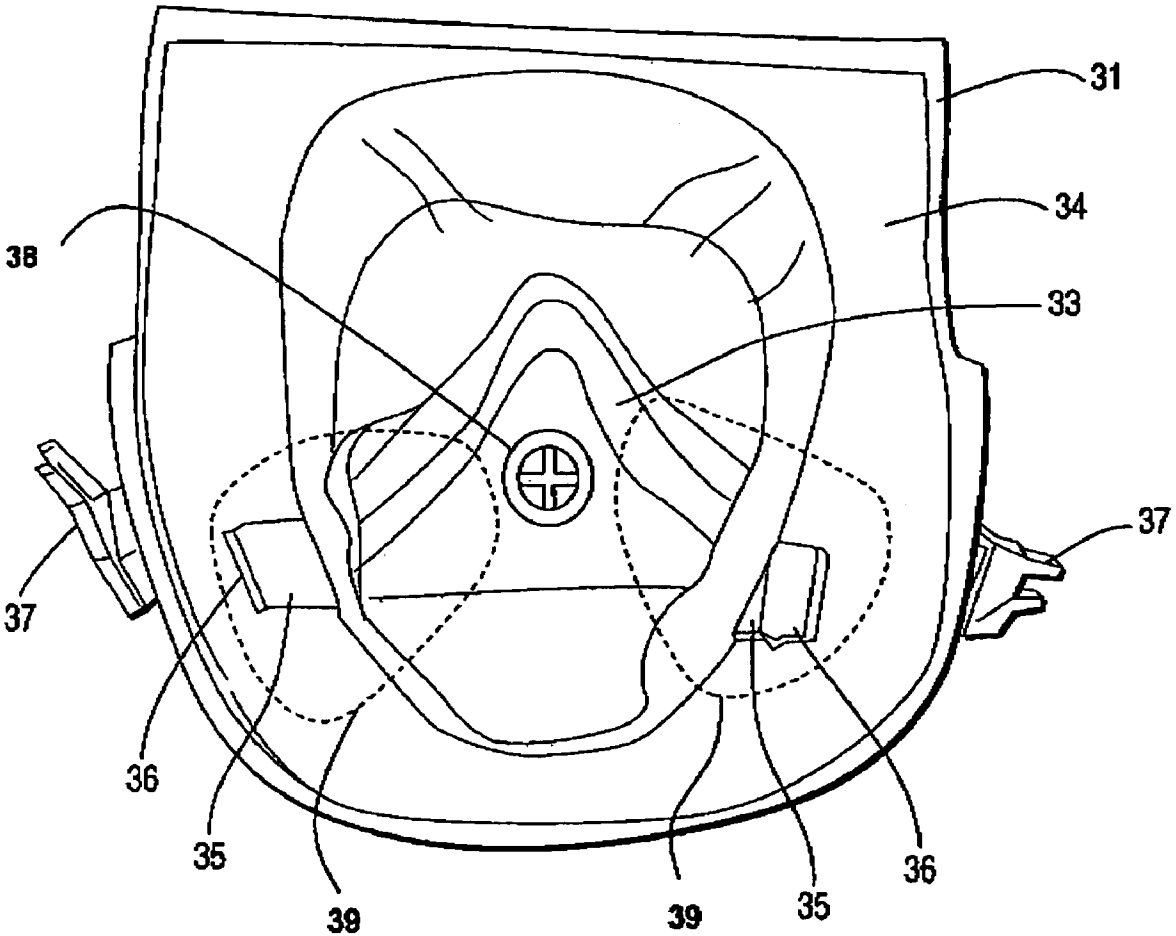
FIG. 4 shows an inside view of a face protection assembly of the invention.

The adjustable head harness 35 is attached at a surface of the face protection shell 31 or the face seal 34. The head harness 35 is preferably capable of engaging the back of a user's head to thereby adjustably secure the face seal 34 and nosecup assembly 33 to the user's face. The head harness 35 may comprise a strap, band, belt, skullcap, or the like, and may comprise any suitable material such as cloth, elastic, plastic, leather, and combinations thereof. In a preferred embodiment, shown in FIG. 4, the head harness 35 comprises a strap which is attached to the face seal 34 by threading the strap through harness clips 36 attached to the face seal 34.

The face protection assembly 30 is alternately attachable to and detachable from the front part 21 of the helmet 20. The face protection assembly 30 preferably comprises attachment fasteners 37 for attaching and detaching the front part 21 of the helmet to the face protection assembly 30 as shown in FIGS. 1 and 2. Suitable attachment fasteners nonexclusively include clips, snaps, straps, hooks, and the like. FIG. 2 shows an embodiment wherein the face protection assembly 30 comprises a clip 37 capable of engaging a clip 27 on the helmet 20, for attaching the face protection assembly 30 to the helmet 20. The face protection assembly 30 may optionally comprise other additional attached or integrated features such as a communications assembly, as described above, an electronic display, and the like.

The invention further comprises a transparent, impact resistant lens 40 which serves to protect the user's eyes. According to the invention, the lens 40 may be fixed to the vision port 32 at the level of the eyes of a user. Alternatively it may be attached at a front part 21 of the helmet 20 and positioned to alternately engage and disengage with the vision port 32 of the face protection shell 31 at the level of the eyes of a user by rotating up into the inside of the helmet 20.

In an embodiment where the lens 40 is fixed to the vision port 32, it may be fixed using any suitable means such as bonding, gluing, screwing, and the like. In an embodiment where the lens 40 is attached at the front part 21 of the helmet 20, it may be attached using any suitable means, such as via a rotatable hinge or the like, which would allow a user to alternately engage and disengage the lens 40 with the vision port 32 of the face protection shell 31 at the level of the eyes of a user. Suitable materials for the lens 40 nonexclusively include polycarbonate, polyurethane, and the like, and combinations thereof.

In a preferred embodiment, the face protection assembly 30 is placed onto a user's head such that the flexible face seal 34 engages the user's face, and such that the nosecup assembly 33 engages the user's mouth and nose. The adjustable head harness is adjusted such that the face seal 34 and nosecup 33 are secured to the user's face. The helmet 20 is then placed onto the user's head such that the helmet 20 encloses the user's head, and the helmet 20 is attached to the face protection assembly 30. A position adjustable adjustment pad 25 of the helmet 20 engages the back of the user's head. The adjustment pad 25 is adjusted by turning a tightening adjustment knob 32 such that it pushes the user's head forward towards a front part 21 of the helmet 20, thereby adjustably securing the face seal 34 and nosecup assembly 33 to the user's face.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A modular helmet-mask assembly which comprises:

(a) a helmet capable of enclosing the head of a user, said helmet comprising an impact resistant material; and (b) a face protection assembly, alternately attachable to and detachable from a front part of said helmet, which face protection assembly comprises (i) a face protection shell comprising an impact resistant material;

(ii) a vision port through the shell at the level of the eyes of a user;

(iii) a flexible nosecup assembly within the shell, which nosecup assembly is positioned to engage the mouth and nose of a user, said nosecup comprising a breathe-through airflow assembly and a filter unit;

(iv) a flexible face seal, disposed on an inner surface of the shell around the nosecup assembly and the vision port, which face seal is capable of engaging the face of a user; and (v) an adjustable head harness attached at a surface of the shell or the face seal which is capable of engaging the back of a user's head to thereby adjustably secure the face seal and nosecup assembly to a user's face, and (c) either (i) or (ii):

(i) a transparent, impact resistant lens fixed to the vision port at the level of the eyes of a user;

(ii) a transparent, impact resistant lens rotatably attached at the front part of the helmet and positioned to alternately engage and disengage with the vision port of the shell at the level of the eyes of a user.

2. The modular helmet-mask assembly of claim 1 further comprising a position adjustable adjustment pad attached at a rear part of said helmet which engages the back of a user's head to thereby adjustably secure the face seal and nosecup assembly to a user's face.

3. The modular helmet-mask assembly of claim 2 wherein said adjustable adjustment pad comprises a tightening adjustment knob or a tightening adjustment lever.

4. The modular helmet-mask assembly of claim 1 comprising a transparent, impact resistant lens fixed to the vision port at the level of the eyes of a user.

5. The modular helmet-mask assembly of claim 1 comprising a transparent, impact resistant lens rotatably attached at the front part of the helmet and positioned to alternately engage and disengage with the vision port of the shell at the level of the eyes of a user.

6. The modular helmet-mask assembly of claim 1 wherein the impact resistant shell material comprises graphite, fiberglass, or combinations thereof.

7. The modular helmet-mask assembly of claim 1 wherein the impact resistant lens comprises polycarbonate, polyurethane, or combinations thereof.

8. The modular helmet-mask assembly of claim 1 wherein the face seal and nosecup comprise an elastic material.

9. The modular helmet-mask assembly of claim 1 wherein the filter unit comprises a filter element comprising a material capable of filtering chemical vapors and biological aerosols.

10. The modular helmet-mask assembly of claim 9 wherein the filter element comprises a carbon filter.

11. A method for protecting a user's face from chemicals which comprises:

(I) providing a modular helmet-mask assembly which comprises (a) a helmet capable of enclosing the head of a user, said helmet comprising an impact resistant material; and (b) a face protection assembly, alternately attachable to and detachable from a front part of said helmet, which face protection assembly comprises (i) a face protection shell comprising an impact resistant material;

(ii) a vision port through the shell at the level of the eyes of a user;

(iii) a flexible nosecup assembly within the shell, which nosecup assembly is positioned to engage the mouth and nose of a user, said nosecup comprising a breathe-through airflow assembly and a filter unit;

(iv) a flexible face seal, disposed on an inner surface of the shell around the nosecup assembly and the vision port, which face seal is capable of engaging the face of a user; and (v) an adjustable head harness attached at a surface of the shell or the face seal which is capable of engaging the back of a user's head to thereby adjustably secure the face seal and nosecup assembly to a user's face, and (c) either (i) or (ii):

(i) a transparent, impact resistant lens fixed to the vision port at the level of the eyes of a user;

(ii) a transparent, impact resistant lens rotatably attached at the front part of the helmet and positioned to alternately engage and disengage with the vision port of the shell at the level of the eyes of a user;

(II) placing the face protection assembly onto a user's head such that the flexible face seal engages the user's face, and such that the nosecup assembly engages the user's mouth and nose;

(III) adjusting the adjustable head harness such that the face seal and nosecup are secured to the user's face;

(IV) placing the helmet onto the user's head such that the helmet encloses the user's head and attaching the helmet to the face protection assembly; and (V) adjusting the helmet to secure the helmet, face seal, and nosecup assembly to the user's head.

12. The method of claim 11 wherein the modular helmet-mask assembly further comprises a position adjustable adjustment pad attached at a rear part of said helmet which engages the back of a user's head to thereby adjustably secure the face seal and nosecup assembly to a user's face, the method further comprising adjusting the adjustment pad such that the face seal and nosecup are secured to the user's face.

13. The method of claim 11 wherein the modular helmet-mask assembly comprises a transparent, impact resistant lens fixed to the vision port at the level of the eyes of a user.

14. The method of claim 11 wherein the modular helmet-mask assembly comprises a transparent, impact resistant lens rotatably attached at the front part of the helmet and positioned to alternately engage and disengage with the vision port of the shell at the level of the eyes of a user.

* * * * *